US008708756B2

(12) United States Patent
Lee et al.

(10) Patent No.: US 8,708,756 B2
(45) Date of Patent: Apr. 29, 2014

(54) REINFORCED CONNECTOR WITH A CROSSTALK PREVENTION FEATURE

(75) Inventors: Kou-Ching Lee, New Taipei (TW); Jian-Li Guan, New Taipei (TW); Ya-Ping Liang, New Taipei (TW); Yao-Te Wang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 20 days.

(21) Appl. No.: 13/484,101

(22) Filed: May 30, 2012

(65) Prior Publication Data

US 2013/0149901 A1 Jun. 13, 2013

(30) Foreign Application Priority Data

Dec. 8, 2011 (CN) ..... 2011 2 0508287 U

(51) Int. Cl.
*H01R 13/514* (2006.01)

(52) U.S. Cl.
USPC ..... 439/701; 439/79

(58) Field of Classification Search
USPC ..... 439/79, 607.07, 701, 607.11
See application file for complete search history.

(56) References Cited

U.S. PATENT DOCUMENTS

| | | | | |
|---|---|---|---|---|
| 6,299,484 | B2 * | 10/2001 | Van Woensel | 439/607.07 |
| 6,409,543 | B1 * | 6/2002 | Astbury et al. | 439/607.07 |
| 6,682,369 | B1 * | 1/2004 | Korsunsky et al. | 439/607.07 |
| 7,758,357 | B2 * | 7/2010 | Pan et al. | 439/108 |
| 8,011,957 | B2 * | 9/2011 | Pan | 439/607.05 |

* cited by examiner

*Primary Examiner* — Hien Vu
(74) *Attorney, Agent, or Firm* — Rabin & Berdo, P.C.

(57) ABSTRACT

A connector includes terminal elements each having a base, multiple terminals securely received in the base with first ends and second ends, positioning blocks formed on one side face of the base and cutouts defined in a top portion of the base, a casing having receiving spaces defined in the casing for receiving the second ends of the terminals, positioning holes each defined to communicate with a corresponding one of the receiving spaces to position therein the second end of the terminals and ribs formed inside the casing to isolate each of the terminals from influence from the other terminals and an insert having receiving holes defined to receive therein the terminal elements and transverse columns corresponding to the cutouts of the terminal elements such that with the transverse columns received in the corresponding cutouts, connection between the insert and the terminal elements is secured.

12 Claims, 4 Drawing Sheets

REINFORCED CONNECTOR WITH A CROSSTALK PREVENTION FEATURE

CROSS-REFERENCE TO RELATED APPLICATION

This application claims priority from application No. 201120508287.0, filed on Dec. 8, 2011 in the State Intellectual Property Office of the People's Republic of China.

FIELD OF THE INVENTION

The invention relates to a connector, and more particularly to a reinforced connector having devices constructed to strengthen the overall structure and ribs formed inside the connector to isolate each of the terminals so as to prevent crosstalk between two adjacent terminals.

BACKGROUND OF THE INVENTION

Due to the increasing demand for electronic devices to be compact and durable, manufacturers all try very hard to meet the requirements. Besides, manufacturers simultaneously improve the function and stability of the electronic devices while trying to minimize the sizes thereof.

As well known in the art that the connector is aimed to be responsible for electrical signal transmission between two electronic devices so that the function and effectiveness of the connector greatly affect the electronic system's overall performance. Following the steps of miniaturization, problems such as crosstalk, propagation delay and medium delay happen inside the electronic system. As a part of the electronic system, the connector too has the aforementioned problems. Especially, because the available space between parts is reducing dramatically, the electrical signal transmission is easily mutually affected.

That is, air is normally used as impedance between two adjacent terminals of a connector. However, when factors in the air change, the function of the connector changes as well.

Factors such as moisture in the air, temperature or even the dust in the air will affect the function of the connector. For example, when the moisture or dust in the air is rich, crosstalk easily happen between the two adjacent terminals and that will affect the stability of dielectric constant and eventually influence the electrical signal transmission.

SUMMARY OF THE INVENTION

The primary objective of the present invention is to provide an improved connector having elements constructed to reinforce the overall structure thereof.

Another objective of the present invention is to provide an improved connector with ribs formed inside the base to prevent mutual influence between two adjacent terminals.

In order to accomplish the aforementioned objectives, the connector constructed in accordance with the present invention includes a casing, terminal elements and an insert. Each of the terminal elements has a base, terminals securely received in the base, positioning blocks formed on a side of the base and a cutout defined in a top surface of the base. The casing defines therein receiving spaces to correspond to the terminals, positioning holes respectively communicating with one of the receiving spaces to position the terminals extending into the receiving spaces and positioning barbs integrally extending outward from one side of the casing to correspond to holes in the bases. The insert has receiving holes and transverse columns formed on a top side of the insert to correspond to the cutout of the bases.

In addition, each of the terminal elements has ribs integrally formed inside the base such that after the terminals are extended into the base, the ribs are able to isolate each of the terminals from mutual interferences.

DETAILED DESCRIPTION OF THE INVENTION

In order to describe details of the preferred embodiment of the present invention, description of the structure, and the application as well as the steps are made with reference to the accompanying drawings. It is learned that after the description, any variation, modification or the like to the structure and the steps of the embodiments of the preferred embodiment of the present invention is easily made available to any person skilled in the art. Thus, the following description is only for illustrative purpose only and does not, in any way, try to limit the scope of the present invention.

Figure 1:
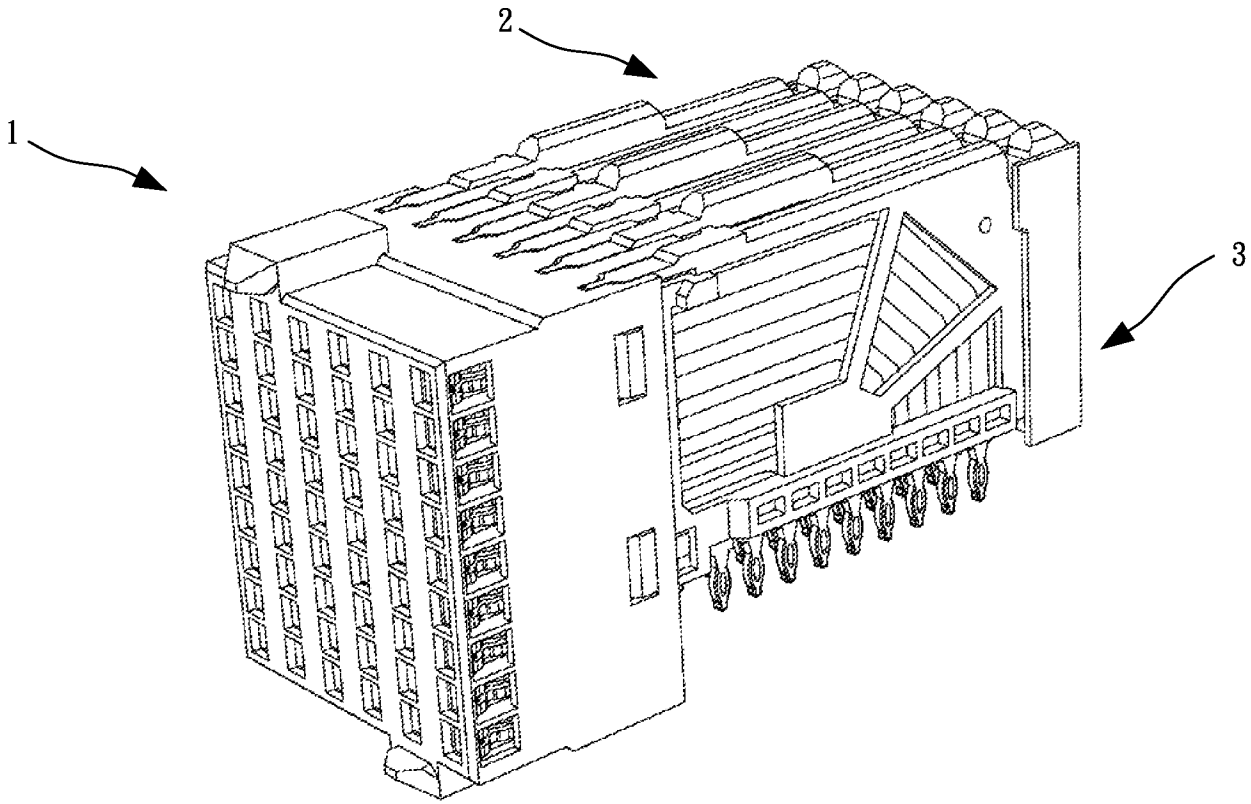
FIG. 1 is a perspective view showing the connector constructed in accordance with the present invention.

With reference to FIG. 1 of the preferred embodiment of the present invention, it is noted that the connector so constructed is composed of a casing 1, multiple terminal elements 2 and an insert 3.

Figure 2:
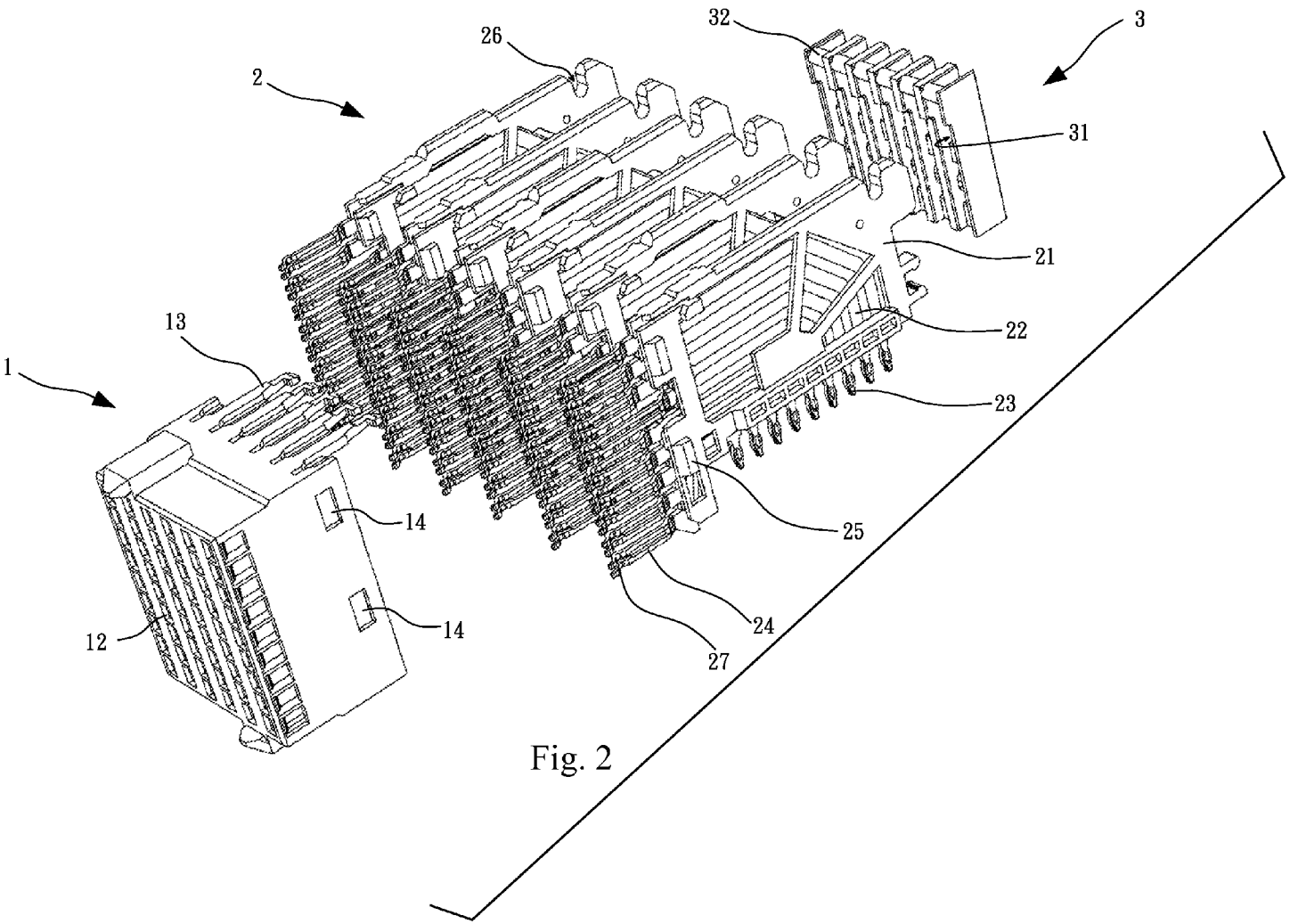
FIG. 2 is an exploded perspective view of the connector in FIG. 1.
Figure 3:
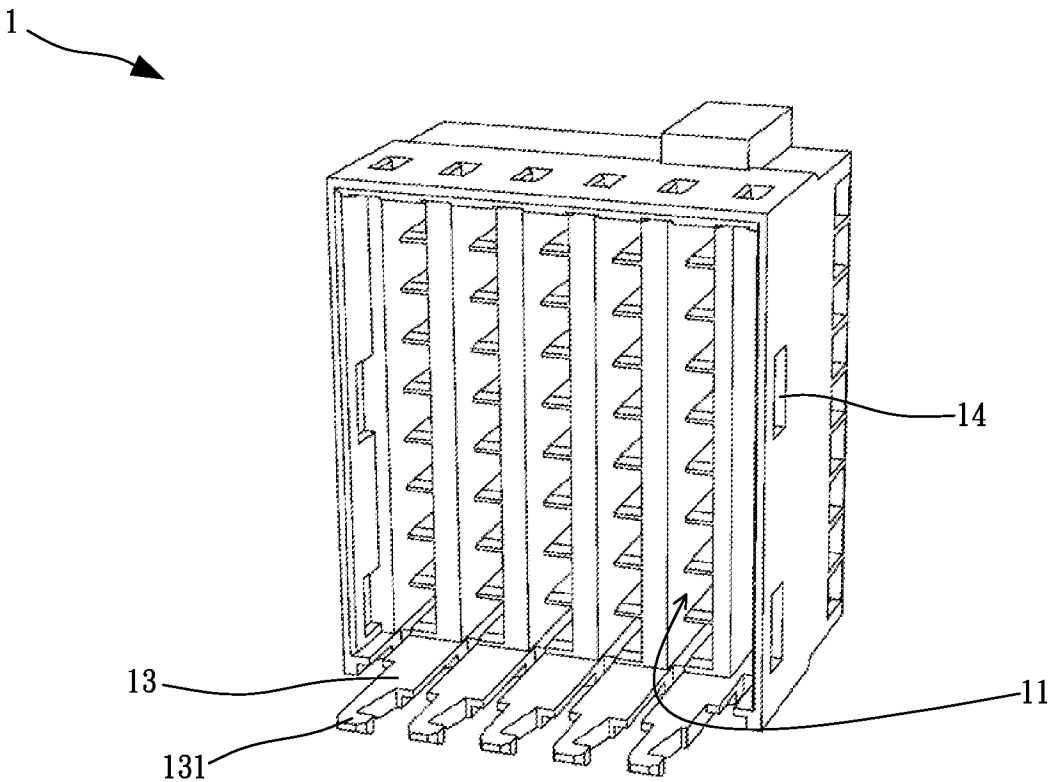
FIG. 3 is a perspective view of the casing in an angle different from that of FIG. 2.
Figure 4:
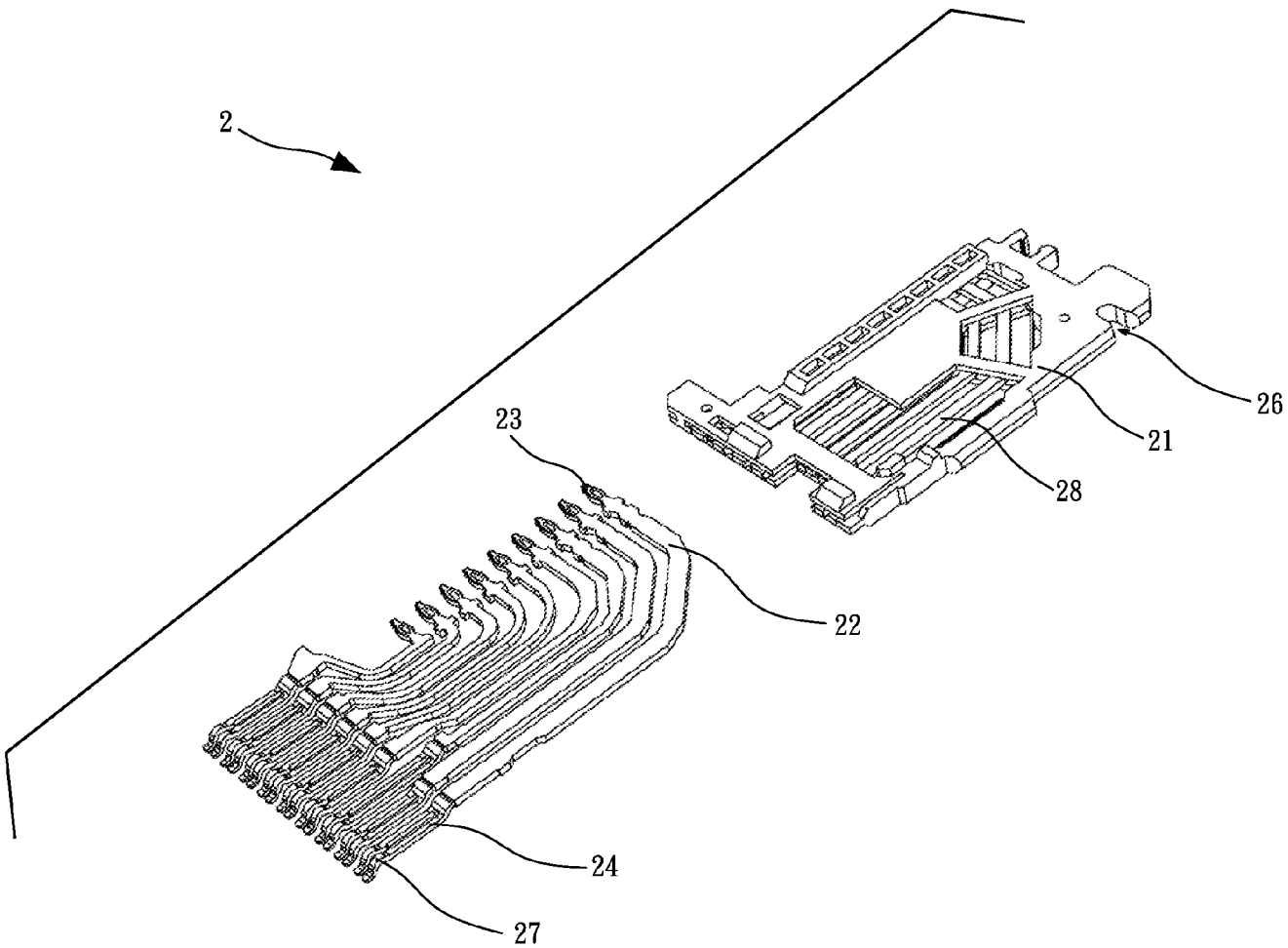
FIG. 4 is an exploded perspective view showing the elements composing the terminal element.

With reference to FIGS. 2, 3 and 4, it is noted that each of the terminal elements 2 has a base 21, terminals 22 securely received in the base 21, positioning blocks 25 formed on a side of the base 21 and a cutout 26 defined in a top surface of the base 21. With reference to FIG. 4, it is noted that each of the terminals 22 has a first end 23 and a second end 24 integrally formed with the first end 23 and having a bend 27 formed on a distal end of the second end 24.

The casing 1 defines therein receiving spaces 11 to correspond to the terminals 22, positioning holes 12 respectively communicating with one of the receiving spaces 11 to position the terminals 22 extending into the receiving spaces 11 and positioning barbs 13 integrally extending outward from one side of the casing 1 to correspond to holes (not numbered) in the base 21. Preferably, the positioning holes 12 are defined alternatively with a 0.075 mm distance between two adjacent positioning holes 12.

The insert 3 has receiving holes 31 and transverse columns 32 formed on a top side of the insert 3 to correspond to the cutout 26 of the bases 21.

Especially, as shown in FIG. 4, it is noted that each base 21 has a rib 28 integrally formed therein to correspond to one of the terminals 22 such that after the terminals 22 are extended into the base 21, the rib 28 of the base 21 is able to isolate one terminal 22 from the others. Preferably, the rib 28 is made of a material, e.g., plastic, with low dielectric coefficient, i.e., 3.8. With the introduction of the rib 28, problems caused by using air as impedance such as crosstalk and stability of the dielectric constant are solved.

When the connector constructed in accordance with the present invention is assembled, it is noted that the first ends 23 of the terminals 22 are inserted into and extended out of the bases 21 of the terminal elements 2 with the second ends 24 extended out of the bases 21 from a different side of the bases 21. Then, by extending the second ends 24 of the terminals 22 into the receiving space 11 of the casing 1 and the positioning barbs 13 extending into the corresponding holes in the bases 21, the second ends 24 of the terminals 22 are secured in the positioning holes 12. Furthermore, due to the provision of the bent 27 in the distal end of the second end 24 of each of the terminals 22, connection of the connector of the present invention with other electronic devices has better clearance. In addition, the positioning barbs 13 formed on one side of the casing 1 are extended into the holes of the bases 21 of the terminal elements 2 to secure the connection between the casing 1 and the bases 21. A further notice is directed to the fact that the cutouts 26 in the upper portion of the terminal elements 2 are defined to correspond to the transverse columns 32 of the insert 3. Therefore, when the insert 3 is to be assembled with the terminal elements 2, the upper portion of the terminal elements 2 are extended into the receiving holes 31 of the insert 3 with the transverse columns 32 received in the corresponding cutouts 26 such that the connection between the insert 3 and the terminal elements 2 is secured.

While the terminal elements 2 are to be assembled with the casing 1, the positioning blocks 25 received in the corresponding securing holes 14 defined in one side face of the casing 1 strengthens the connection between the terminal elements 2 and the casing 1.

While the invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A connector comprising:

terminal elements each having:

a base;

multiple terminals securely received in the base with first ends thereof extended out from one side of the base and second ends thereof extended out from the other side of the base;

positioning blocks formed on one side face of the base; and cutouts each defined in a top portion of each of the bases;

a casing having:

receiving spaces defined in the casing for receiving the second ends of the terminals;

positioning holes each defined to communicate with a corresponding one of the receiving spaces to position therein the second end of a corresponding one of the terminals; and ribs formed inside the casing to isolate each of the terminals from influence from the other terminals; and an insert for covering ends of the bases having:

receiving holes defined to receive therein a top portion of each of the terminal elements; and transverse columns formed in upper portions of the receiving holes to correspond to the cutouts of the terminal elements such that with the transverse columns received in the corresponding cutouts, connection between the insert and the terminal elements is secured.

2. The connector as claimed in claim 1, wherein the casing further has positioning barbs extending from one side face of the casing for securing connection with the terminal elements.

3. The connector as claimed in claim 2, wherein the ribs are made of a material with low dielectric coefficient.

4. The connector as claimed in claim 2, wherein the positioning holes are alternatively defined with a 0.075 mm distance between two adjacent positioning holes.

5. The connector as claimed in claim 1, wherein the casing has securing holes defined in one side face thereof to correspond to and receive therein the positioning blocks.

6. The connector as claimed in claim 1, wherein the positioning holes are alternatively defined with a 0.075 mm distance between two adjacent positioning holes.

7. The connector as claimed in claim 2, wherein the casing has securing holes defined in one side face thereof to correspond to and receive therein the positioning blocks.

8. The connector as claimed in claim 7, wherein the ribs are made of plastic.

9. The connector as claimed in claim 7, wherein the positioning holes are alternatively defined with a 0.075 mm distance between two adjacent positioning holes.

10. The connector as claimed in claim 8, wherein the positioning holes are alternatively defined with a 0.075 mm distance between two adjacent positioning holes.

11. The connector as claimed in claim 2, wherein the ribs are made of plastic.

12. The connector as claimed in claim 11, wherein the positioning holes are alternatively defined with a 0.075 mm distance between two adjacent positioning holes.

* * * * *